US006730887B2

(12) United States Patent
Horey et al.

(10) Patent No.: US 6,730,887 B2
(45) Date of Patent: May 4, 2004

(54) WARMING BLANKET HAVING REMOTE SAFETY CIRCUIT

(75) Inventors: Leonard I. Horey, Boca Raton, FL (US); Armando Alvite, Miami, FL (US); Gabriel Kohn, Boca Raton, FL (US)

(73) Assignee: Sunbeam Products, Inc., Boca Raton, FL (US)

( * ) Notice: Subject to any disclaimer, the term of this patent is extended or adjusted under 35 U.S.C. 154(b) by 0 days.

(21) Appl. No.: 10/242,905

(22) Filed: Sep. 10, 2002

(65) Prior Publication Data

US 2003/0047556 A1 Mar. 13, 2003

Related U.S. Application Data

(60) Provisional application No. 60/318,999, filed on Sep. 11, 2001.

(51) Int. Cl.[7] ..... H05B 1/02

(52) U.S. Cl. ..... 219/497; 219/212; 219/217; 219/505

(58) Field of Search ..... 219/482, 489, 219/490, 494, 497, 499, 501, 505, 507, 509, 510, 527, 528, 538, 541, 542, 200, 201, 212, 217; 5/423, 941

(56) References Cited

U.S. PATENT DOCUMENTS

| | | | | |
|---|---|---|---|---|
| 4,436,986 A | | 3/1984 | Carlson | |
| 4,797,537 A | * | 1/1989 | Berthelius et al. | 219/528 |
| 5,420,397 A | | 5/1995 | Weiss et al. | |
| 5,770,836 A | | 6/1998 | Weiss | |
| 6,246,556 B1 | | 6/2001 | Haun et al. | |
| 6,473,920 B2 | * | 11/2002 | Augustine et al. | 5/423 |

* cited by examiner

*Primary Examiner*—Tu Ba Hoang
(74) *Attorney, Agent, or Firm*—Lawrence J. Shurupoff

(57) ABSTRACT

One or more current sensors are mounted externally of a heating member so as to simplify construction of the heating member. The sensors are particularly useful in safety control circuits for heating members using PTC wire as resistance heating elements.

13 Claims, 2 Drawing Sheets

WARMING BLANKET HAVING REMOTE SAFETY CIRCUIT

This application claims the benefit of U.S. Provisional Application Serial No. 60/318,999 filed Sep. 11, 2001.

FIELD OF THE INVENTION

The present invention relates to electric heating blankets, pads and pillows.

DESCRIPTION OF PRIOR DEVELOPMENTS

Present day warming blankets typically include a safety circuit for interrupting or cutting off electrical power to the blanket in the event of an electrical fault such as arcing, a short circuit or an open circuit.

Conventional safety circuits measure voltage at the remote end of the heating wire, i.e., the end farthest from where the wire enters the blanket. This form of measurement requires a safety circuit module to be located inside the blanket or an additional pair of wires must be returned to the controller located on the exterior of the blanket. This requires the heating wire to complete a full circuit loop within the blanket and return back to the edge of the blanket where the resistance heating wire is connected to an external power cord. This connection requires an additional electrical connector pin or pins.

It would be advantageous to be able to externally measure only the current entering a warming blanket or pad in order to detect an electrical fault in the resistance/heating wire. This would be particularly advantageous in the case of resistance wire fabricated from PTC (positive temperature coefficient) wire. In this case a complete looped circuit would not be required and a simplified and more economical blanket construction would be enabled.

In any case, by measuring the current entering the blanket, a safety circuit can be located remotely and externally of the blanket.

SUMMARY OF THE INVENTION

The invention has been developed to fulfill the needs noted above. A primary object of the invention is to provide an electric fault detector positioned externally from a heating blanket without the need for extending one or more wires back to the external controller. This object is achieved by locating most of the fault detecting electronics in an application specific integrated circuit (ASIC). This reduces both the safety circuit size and its cost.

The resulting safety circuit can be located on a controller or near an electrical connector, i.e., near a wall plug, if desired. The combination of the safety circuit and the wall plug can be molded as a single compact module, if desired. By positioning the safety circuit at the wall plug and measuring electrical faults at this point, faults between the wall plug and blanket can be immediately detected, i.e., faults in the power cord. Prior safety circuits located at the blanket could not detect such faults.

DETAILED DESCRIPTION OF THE PREFERRED EMBODIMENT

Figure 1:
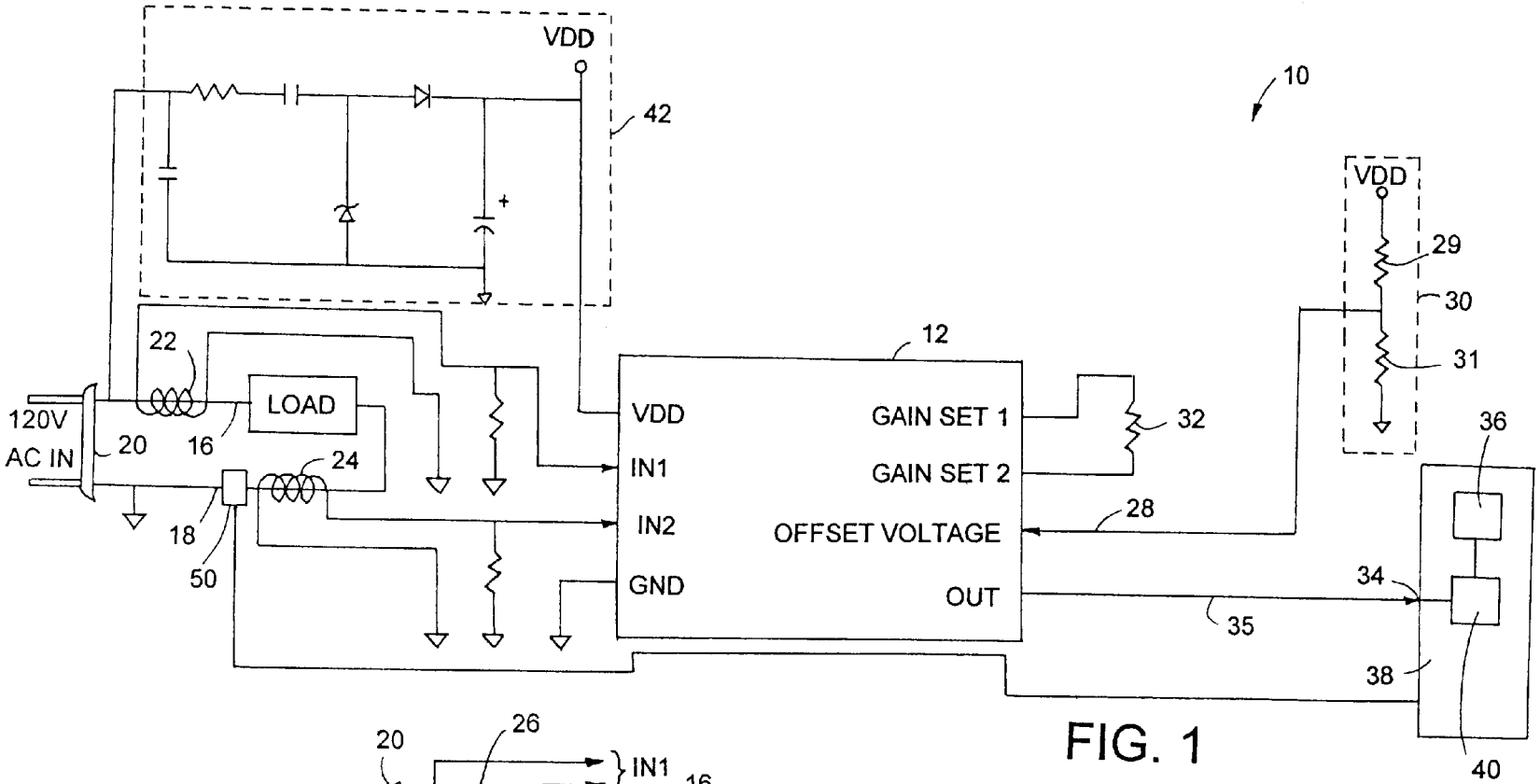
FIG. 1 is a schematic circuit diagram of a safety circuit constructed in accordance with the invention.

The present invention will now be described in conjunction with FIG. 1 which shows a safety circuit 10 including an application specific integrated circuit or ASIC 12. In the example shown, the ASIC is a custom CMOS ASIC. If desired, discrete components can be mounted on a circuit board instead of using an ASIC. However, an ASIC is preferred because of its compact size and ability to be packaged as a small unobtrusive module or chip.

Figure 2:
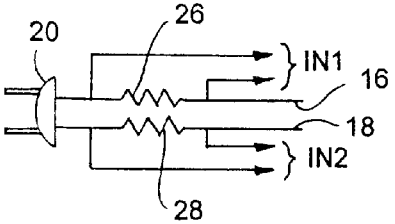
FIG. 2 is a view of an alternate sensor for use in the circuit of FIG. 1.

Each power wire 16, 18 on power wall plug 20 extends through a small current sensor 22, 24. The current sensors 22, 24 produce a voltage output when current flows through the respective power wires 16, 18. These voltages, IN1 and IN2, are input into the ASIC 12. The current sensors are preferably coils, i.e., ferrite toroids, but can also be small resistors, 26, 28, i.e., 0.1 ohm, as shown in FIG. 2. The voltage drop across the resistors produces a similar voltage input signal to that produced by the sensors 22, 24.

The ASIC amplifies and processes the input signal(s) from the current sensors 22, 24 (or 26, 28) and determines or calculates an average sensor signal value based on the two inputs. However, if desired, only one sensor 16 or 18 (or 26 or 28) can be used to input a single voltage signal IN2. Two sensors are preferred for the ability to detect a short circuit.

The resulting average (or single) voltage signal is preferably offset by a predetermined amount set by an external offset voltage 28 produced by a voltage divider 30 having resistors 29, 31. The average (or single) voltage signal is also preferably amplified by a gain determined by, for example, an external 1% resistor 32, for example. The resulting output control signal 34 is sent through signal wire 35 is in the form of an analog voltage signal which is proportional to the current in the line or power cords 16, 18.

The analog voltage signal 34 is sent to a microcomputer 36 in a conventional controller 38. An analog to digital (A/D) converter 40 located in the microcomputer 36, or elsewhere, receives the analog voltage signal 34 and converts it to a digital signal. The digital signal is processed by the microcomputer 36 to monitor the current in the power cords 16, 18 and check for abnormal current values which indicate a fault condition. A triac 50 in series with the line 18 allows the microcomputer 36 to control power to the heating pad or blanket. When a fault condition is detected, the controller switches off the power from power cords 16, 18 to the heating pad or blanket.

The entire safety circuit 10 can be located in the controller 38 or externally of the controller 38 such as in power cord plug 20. The safety circuit 10 includes the current sensors 22, 24, the ASIC 12 (or equivalent discrete components), the gain resistor 32, the offset voltage setting resistors 29, 31 and a small optional power supply 42 for powering the ASIC in the case where the ASIC is mounted on plug 20.

When the safety circuit 10 is mounted by the wall plug 20, the safety circuit is preferably molded with the wall plug 20 into a single unitary plug assembly or module. In this case, three wires would extend from the plug module to the blanket controller 38, i.e., the two power wires 16, 18 and the safety signal wire 35.

A major advantage of the present invention is the ability to use the same ASIC for controlling different sizes and types of heating pads, blankets, pillows, etc. each having different current flow characteristics. Instead of redesigning the ASIC, one need only change the value of the external gain resistor 32 and/or the values of the offset voltage resistor(s) 29, 31 in voltage divider 30 to adapt the ASIC for different control applications and to optimize signal 35 for processing over the full useful input range of controller 38.

Another advantage of the invention is the elimination of any electronic components in the pad or blanket, since the circuit 10 can be located completely externally of the pad or blanket. This facilitates blanket/pad assembly and removes bulky components from the blanket/pad.

Figure 3:
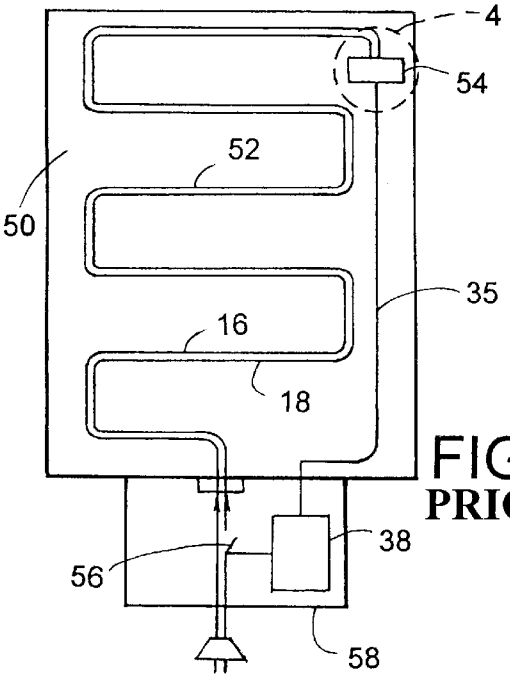
FIG. 3 PRIOR ART
FIG. 3 is a schematic top plan view showing a heating pad or blanket constructed in accordance with the Prior Art.

Another major advantage of the invention is the ability to eliminate a return signal wire or wires 35 from the end of the resistance wire which heats the blanket or pad. For example, as seen in FIG. 3, the prior art heating blanket 50 has a serpentine loop of PTC resistance wire 52 which terminates at an active safety circuit module 54. When a predetermined voltage variation is detected in wire 52 by module 54, a signal is sent to controller 38 via signal wire 35 to open switch 56 and terminate power to resistance wire 52 in connector housing 58.

Figure 4:
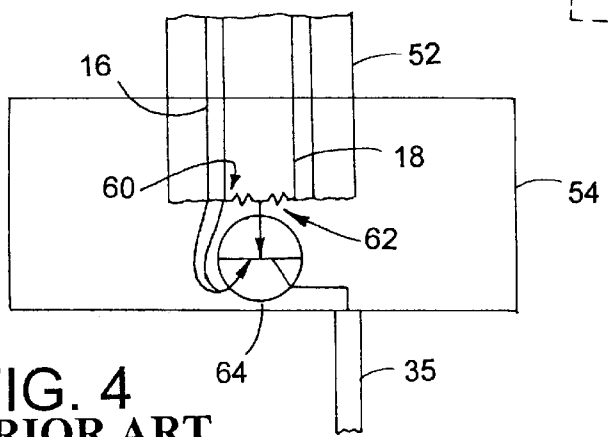
FIG. 4 PRIOR ART
FIG. 4 is an enlarged partial view of the portion of FIG. 3 enclosed in dashed lines.

As seen in FIG. 4, module 54 can include one or more resistors 60, 62 extending across power wires 16, 18 at the remote end of wire 52. The base of transistor 64 is connected between the resistors to send a go or no-go signal to signal wire 35 to control the operation of switch 56. The module 54 complicates the assembly of blanket 50 as does signal wire 35.

Figure 5:
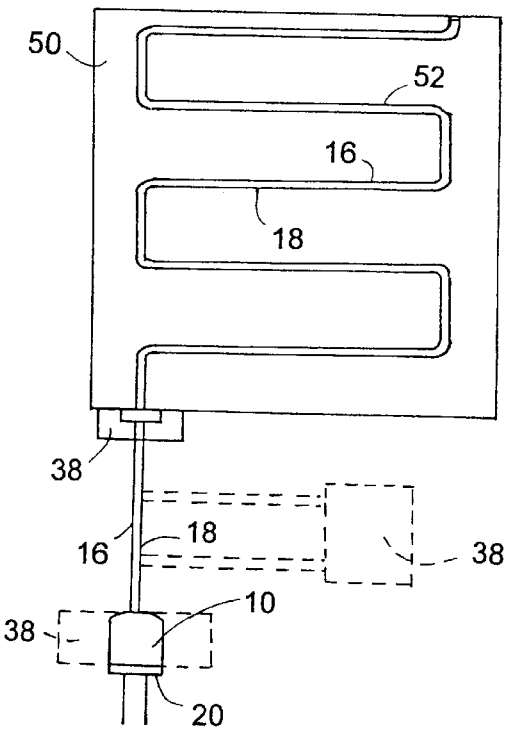
FIG. 5 is a view similar to FIG. 3 showing a blanket constructed in accordance with the invention.

A much simpler to fabricate blanket assembly is shown in FIG. 5 wherein module 54 and return wire 35 are eliminated from the blanket construction and located remote from the blanket in accordance with the invention. The safety circuit 10 of FIG. 1 can be mounted on wall plug assembly or module 20, or the safety circuit 10 can be mounted in controller 38, which can be mounted adjacent or remote from the blanket 50.

Blanket 50 is shown for explanation purposes only. Blanket 50 can be any heating member, generally including a flexible, pliable, soft and compliant cover made of a fabric or sheet material, and a resistance wire held within the outer layers of the cover.

What is claimed is:

1. A heating assembly, comprising:

a pliable cover;

a heating element provided within said cover;

a safety circuit located externally of said cover for controlling power supplied to said heating element; said circuit comprising at least one sensor for detecting electrical current supplied to said heating element and generating an output signal; and a power cord having a wall plug, and wherein said safety circuit is mounted on said wall plug.

2. The assembly of claim 1, wherein said cover comprises a blanket.

3. The assembly of claim 1, wherein said sensor comprises a coil.

4. The assembly of claim 1, wherein said heating element comprises positive temperature coefficient wire.

5. The assembly of claim 1, further comprising an application specific integrated circuit receiving said output signal and producing a control signal.

6. The assembly of claim 5, further comprising a controller receiving said control signal.

7. The assembly of claim 1, further comprising a controller, and wherein said safety circuit is carried by said controller.

8. The assembly of claim 1, wherein said at least one sensor comprises a pair of sensors, which produce a pair of output voltage signals.

9. The assembly of claim 8, further comprising an application specific integrated circuit receiving and processing said output voltage signals to produce a control signal.

10. The assembly of claim 1, further comprising an application specific integrated circuit receiving said output signal and producing a control signal and a gain resistor connected to said application specific integrated circuit for adapting said application specific integrated circuit to a specific application.

11. The assembly of claim 1, further comprising an application specific integrated circuit receiving said output signal and producing a control signal and a voltage divider connected to said application specific integrated circuit for adapting said application specific integrated circuit to a specific application.

12. A heating assembly, comprising:

a pliable cover;

a heating element provided within said cover;

a safety circuit located externally of said cover for controlling power supplied to said heating element; and a power cord having a wall plug for supplying power to said heating element, and wherein said safety circuit is disposed on said wall plug.

13. The assembly of claim 12, wherein said safety circuit comprises a sensor for generating an output signal.

* * * * *